US007201210B2

(12) United States Patent
Saha et al.

(10) Patent No.: US 7,201,210 B2
(45) Date of Patent: Apr. 10, 2007

(54) CASTING OF ALUMINUM BASED WROUGHT ALLOYS AND ALUMINUM BASED CASTING ALLOYS

(75) Inventors: Deepak Saha, Worcester, MA (US); Sumanth Shankar, Dundas (CA); Diran Apelian, West Boylston, MA (US); Makhlouf M. Makhlouf, Shrewsbury, MA (US)

(73) Assignee: Worcester Polytechnic Institute, Worchester, MA (US)

( * ) Notice: Subject to any disclaimer, the term of this patent is extended or adjusted under 35 U.S.C. 154(b) by 0 days.

(21) Appl. No.: 11/002,726

(22) Filed: Dec. 2, 2004

(65) Prior Publication Data

US 2005/0167011 A1 Aug. 4, 2005

Related U.S. Application Data

(60) Provisional application No. 60/526,221, filed on Dec. 2, 2003.

(51) Int. Cl.
*B22D 1/00* (2006.01)
*B22D 27/00* (2006.01)

(52) U.S. Cl. ..... 164/57.1; 164/55.1

(58) Field of Classification Search ..... 164/55.1–59.1
See application file for complete search history.

(56) References Cited

U.S. PATENT DOCUMENTS

| | | | | |
|---|---|---|---|---|
| 4,080,200 | A | 3/1978 | Sheridan | |
| 4,248,630 | A * | 2/1981 | Balmuth | 420/528 |
| 4,522,784 | A * | 6/1985 | Enright et al. | 420/590 |
| 6,123,899 | A | 9/2000 | Setzer et al. | |

FOREIGN PATENT DOCUMENTS

| | | |
|---|---|---|
| EP | 0 302 803 | 2/1989 |
| EP | 0 964 069 A1 | 12/1999 |
| EP | 0 992 598 A1 | 4/2000 |
| GB | 2 174 103 A | 10/1986 |

OTHER PUBLICATIONS

Fuminori, Patent Abstracts of Japan, Publication No. 11279670, Publication Date: Oct. 12, 1999, "Master Alloy for Regulating Content of Magnesium to be Used at the Time of Recasting Zinc Alloy".

Katsuaki, Patent Abstracts of Japan, Publication No. 2002309321, Publication Date: Oct. 23, 2002, "High Concentrated Silicon Aluminum Alloy and its Producing Method".

XP002317271; ISBN: 0-87433-157-9: Collective: Aluminum Casting Technology, 2nd Edition, 1993, AFS American Foundry Men Society Inc., pp. 66-67.

XP002317272: ISBN: 0-87433-157-9: Collective: Aluminum Casting Technology, 2nd Edition, 1993, AFS American Foundry Men Society Inc., pp. 28-39.

* cited by examiner

*Primary Examiner*—Kuang Y. Lin
(74) *Attorney, Agent, or Firm*—Wilmer Cutler Pickering Hale and Dorr LLP

(57) ABSTRACT

Preferred embodiments of the present invention include methods that allow for casting alloys, and preferentially casting wrought alloys to circumvent problems such as, for example, hot tearing. Preferred embodiments of the present invention provide for alloys having predominantly spherical primary α-aluminum grains in their microstructure (i.e., substantially free of dendrites) formed by mixing two liquids of differing compositions that are held at predetermined temperatures, such that when mixed they produce a predetermined alloy composition at a predetermined temperature that is inclined to solidify with a predominantly spherical grain structure that minimizes the alloy's tendency towards hot tearing.

19 Claims, 5 Drawing Sheets

200 μm

CASTING OF ALUMINUM BASED WROUGHT ALLOYS AND ALUMINUM BASED CASTING ALLOYS

CROSS-REFERENCE TO RELATED APPLICATIONS

This application claims the benefit of U.S. Provisional Patent Application Ser. No. 60/526,221 filed Dec. 2, 2003, the entire contents of which is incorporated herein by reference.

TECHNICAL FIELD

This invention relates generally to casting of wrought alloys and casting alloys.

BACKGROUND

Aluminum-based alloys, for example alloys that belong to the 2xxx series, which contain primarily aluminum and copper, alloys that belong to the 3xxx series, which contain primarily aluminum and manganese, alloys that belong to the 4xxx series, which contain primarily aluminum and silicon, alloys that belong to the 5xxx series, which contain primarily aluminum and magnesium, alloys that belong to the 6xxx series, which contain primarily aluminum, magnesium, and silicon, and alloys that belong to the 7xxx series, which are complex alloys that contain primarily aluminum, zinc, copper, and magnesium, are used extensively in the aerospace industry and the automotive industry due to their high tensile strength and good ductility. One of the biggest problems in the casting of these alloys has been their high coherency temperature and their tendency to form hot tears during solidification. Hot tears are brittle interdendritic fractures that initiate during solidification of castings. Alloys with larger solidification ranges, and alloys that solidify into structures where the primary aluminum phase is predominantly dendritic, as well as alloys that solidify with large as-cast grain size are more prone to hot tearing than others. Accordingly, many aluminum-based alloys that belong to these systems are termed wrought aluminum alloys. Wrought alloys are worked, i.e., they are extruded, forged, etc., subsequent to casting. This provides for enhanced properties induced by the mechanical hot working. In contrast to casting alloys, which must contain specific elements that improve their casting characteristics, wrought alloys do not suffer from this constraint and are designed primarily for enhanced properties. There is a need to provide a method that allows casting of aluminum-based alloys that are not composition-restricted. Specifically, there is a need to provide a method that allows easy casting of aluminum-based wrought alloys into components that have microstructures that do not result in hot tears and have desirable mechanical properties including high strength and good ductility.

SUMMARY OF THE INVENTION

Preferred embodiments of the present invention include methods that allow for casting alloys, and preferentially casting wrought alloys to circumvent problems such as, for example, hot tearing. Preferred embodiments of the present invention provide for alloys having predominantly spherical primary $\alpha$-aluminum grains in their microstructure (i.e., substantially free of dendrites) formed by mixing two liquids of differing compositions that are held at predetermined temperatures, such that when mixed they produce a predetermined alloy composition at a predetermined temperature that is inclined to solidify with a predominantly spherical grain structure that minimizes the alloy's tendency towards hot tearing.

In accordance with an embodiment, a method of the present invention includes a casting process comprising the steps of heating a first alloy to form a liquid alloy at a first temperature, heating a second alloy to form a second liquid alloy at a second temperature, combining the first and second liquid alloys to form a super cooled alloy having a predetermined composition and temperature, and casting the resultant liquid alloy to form a solid whose microstructure is substantially free of dendrities. The first alloy is commercially pure aluminum and the second alloy is aluminum and a component such as copper, zinc, magnesium, or a combination thereof. In an embodiment, the second alloy is aluminum and copper in a range from about 2% to about 33%. In an embodiment, the first alloy is commercially pure aluminum and the second alloy is aluminum and 33 weight percent copper.

The casting method includes heating the first alloy to a temperature of 665° C.±5° C. and heating the second alloy to a temperature of 551° C.±5° C. and casting the resultant alloy to produce a component with a microstructure that is essentially free of dendrites.

In accordance with another aspect of the present invention, a component manufactured using the system and method in accordance with an embodiment of the present invention is characterized by a microstructure with a substantial absence of dendritic structures.

In another embodiment of the present invention, the first alloy is aluminum, 12.8 weight percentage silicon, and 0.02 weight percentage strontium, and the second alloy is commercially pure aluminum. The casting method of this embodiment includes heating the first alloy to a temperature of 583±5° C. and heating the second alloy to a temperature of 551±5° C. and casting the resultant alloy to produce a component with a microstructure that is essentially free of dendrites.

In another embodiment of the present invention, the first alloy is aluminum and 35 weight percent magnesium and the second alloy is commercially pure aluminum. The casting method of this embodiment includes heating the first alloy to a temperature of 455±5° C. and heating the second alloy to a temperature of 665° C.±5° C. and casting the resultant alloy to produce a component with a microstructure that is essentially free of dendrites.

In another embodiment of the present invention, the first alloy is aluminum and 22 weight percent copper, and the second alloy is aluminum, 7 weight percent zinc, and 2.65 weight percent magnesium. The casting method of this embodiment includes heating the first alloy to a temperature of 600±5° C. and heating the second alloy to a temperature of 640±5° C. and casting the resultant alloy to produce a component with a microstructure that is essentially free of dendrites.

In yet another embodiment of the present invention, the first alloy is commercial A356 alloy and the second alloy is aluminum and 33 weight percentage copper. The casting method of this embodiment includes heating the first alloy to a temperature of 621±5° C. and heating the second alloy to a temperature of 551±5° C. and casting the resultant alloy to produce a component with a microstructure that is essentially free of dendrites.

In another embodiment of the present invention, a cast component made in accordance with the present invention is heat treated subsequent to its casting using any of the industry standard heat treatment methods, for example, heat-treatment according to, but not limited to, standard O, H or T temper designations.

In yet another embodiment of the present invention, a cast component made according to the present invention is heat treated subsequent to its casting using a heat treatment method that is specifically designed to increase the strength and hardness of the cast component. These strain-hardening methods can include, without limitation, H1, H2, H3, H12–H18, H22, H24, H26, H28, H32, H34, H36 and H38 tempers.

In accordance with another aspect of the invention, a cast alloy component comprises an alloy composition having a microstructure that is substantially free of dendrites and has a predominantly spherical grain structure. The alloy has at least one of a predominantly globular, cellular or rosette like microstructure. The alloy composition comprises a first and second alloy as described hereinbefore.

The foregoing and other objects, features and advantages of the invention will be apparent from the following more particular description of embodiments of the invention, as illustrated in the accompanying drawings. The drawings are not necessarily to scale, emphasis instead being placed upon illustrating the principles of the invention.

DETAILED DESCRIPTION

Figure 1A:
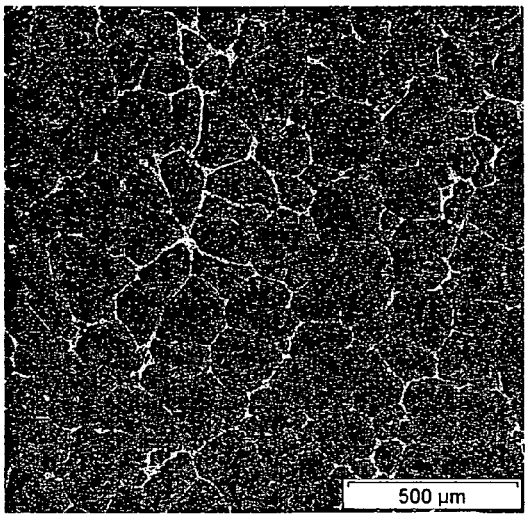
FIGS. 1A and 1B illustrate scanning electrons microscope (SEM) images of the microstructure of standard alloy 2014 produced (a) via a method of the present invention, and (b) via conventional permanent mold casting technology, respectively.

In accordance with the present invention, a method is provided for making cast components from aluminum-based alloys of compositions that can be generally described as Al-X, where X is silicon, copper, magnesium, zinc, or any combination of two, three, or all four of these elements, together with minor quantities of other elements including, but not limited to the elements actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements.

In an embodiment, the method for forming cast components from aluminum-based wrought alloys uses compositions that belong to the 2xxx, 3xxx, 4xxx, 5xxx, 6xxx, and 7xxx series, as well as cast components from aluminum-based casting alloys of compositions that belong to the 2xx, 3xx, 4xx, 5xx, 6xx, and 7xx series.

The methods of the present invention include the steps of heating a first alloy to form a liquid alloy at a first temperature, heating a second alloy to form a second liquid alloy at a second temperature, combining the first and second liquid alloys to form a super cooled alloy, and casting the resultant super cooled alloy to form a solid that has a predominantly globular, cellular, or rosette-like microstructure that is substantially free of dendrites. The chemistry of the first alloy and its temperature and the chemistry of the second alloy and its temperature are chosen such that the resultant alloy is of a pre-determined composition and temperature.

In an embodiment of the present invention, the first alloy is commercially pure aluminum and the second alloy is aluminum and 33 weight percent copper. The casting method of this preferred embodiment includes heating the first alloy to a temperature of 665±5° C. and heating the second alloy to a temperature of 551° C.±5° C. and casting the resultant alloy to produce a component with a microstructure that is essentially globular and free of dendrites.

In another embodiment of the present invention, the first alloy is aluminum, 12.8 weight percentage silicon, and 0.02 weight percentage strontium, and the second alloy is commercially pure aluminum. The casting method of this embodiment includes heating the first alloy to a temperature of 583±5° C. and heating the second alloy to a temperature of 551±5° C. and casting the resultant alloy to produce a component with a microstructure that is essentially free of dendrites.

In another embodiment of the present invention, the first alloy is aluminum and 35 weight percent magnesium and the second alloy is commercially pure aluminum. The casting method of this embodiment includes heating the first alloy to a temperature of 455±5° C. and heating the second alloy to a temperature of 665° C.±5° C. and casting the resultant alloy to produce a component with a microstructure that is essentially free of dendrites.

In another embodiment of the present invention, the first alloy is aluminum and 22 weight percent copper, and the second alloy is aluminum, 7 weight percent zinc, and 2.65 weight percent magnesium. The casting method of this embodiment includes heating the first alloy to a temperature of 600±5° C. and heating the second alloy to a temperature of 640±5° C. and casting the resultant alloy to produce a component with a microstructure that is essentially free of dendrites.

In another embodiment of the present invention, the first alloy is commercial A356 alloy and the second alloy is aluminum and 33 weight percentage copper. The casting method of this embodiment includes heating the first alloy to a temperature of 621±5° C. and heating the second alloy to a temperature of 551±5° C. and casting the resultant alloy to produce a component with a microstructure that is essentially free of dendrites.

In another embodiment of the present invention, a cast component made in accordance with the present invention is heat treated subsequent to its casting using any of the industry standard heat treatment methods, for example, heat-treatment according to, but not limited to, standard O, H or T temper designations.

In yet another embodiment of the present invention, a cast component made according to the present invention is heat treated subsequent to its casting using a heat treatment method that is specifically designed to increase the strength and hardness of the cast component. These strain-hardening methods can include, without limitation, H1, H2, H3, H12–H18, H22, H24, H26, H28, H32, H34, H36 and H38 tempers.

Various advantages of the invention are apparent from the following examples and it will be understood that the following examples are presented to illustrate the invention and are not intended as any limitation thereof.

EXAMPLE 1

A method of the present invention is used to produce a cast component with the composition of standard 2014 alloy; namely, aluminum, 3.9–5.0 weight percentage copper, 0.2–0.8 weight percentage magnesium, and 0.4–1.2 weight percentage manganese. Accordingly, 0.86 pounds of commercially pure aluminum is melted in a ceramic crucible and held at 665±5° C. Similarly, 0.14 pounds of a second alloy with the composition aluminum+33 weight percentage copper is melted in a second ceramic crucible and held at 551±5° C. The two alloys are mixed and the resultant alloy is immediately cast in a preheated metal mold. The chemistry of the resultant solidified alloy was measured using spark emission spectroscopy and the microstructure of polished metallographic samples taken from the solidified alloy was examined using optical and scanning electron microscopy. These characteristics of the resultant alloy are compared to the corresponding characteristics of standard 2014 aluminum alloy.

The measured chemistry of the alloy produced according to the present invention as described in this example is as follows: aluminum, 4.5 weight percentage copper, 0.2 weight percentage magnesium, and 0.5 weight percentage manganese.

Figure 1B:
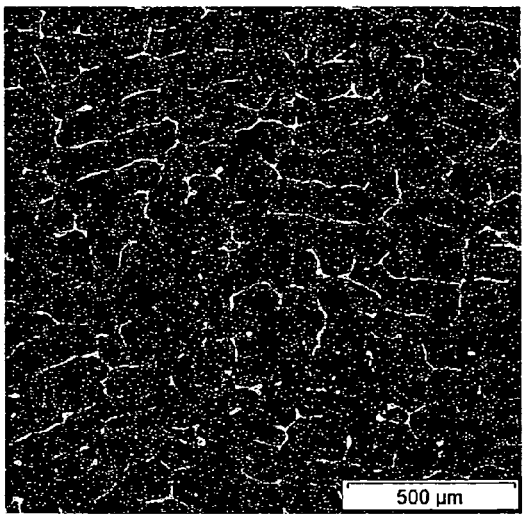

FIG. 1A shows the microstructure of the alloy produced according to the present invention as described in this example, and FIG. 1B shows the microstructure of standard 2014 wrought alloy. The morphology of the grains in the alloy produced according to the invention as described in this example is predominantly spherical and there are very few, if any, dendrites in the microstructure. The interdendritic liquid in the alloy produced according to the invention as described in this example is more dispersed in the microstructure and envelopes the spherical grains. This microstructure, compared to that of standard 2014 wrought alloy, is predominantly globular and substantially free of dendrites, has much less tendency for hot tearing, and is more amenable to producing sound castings.

EXAMPLE 2

A method of the present invention is used to produce a cast component with the composition of standard 4145 alloy; namely, aluminum, 9.3–10.7 weight percentage silicon, 3.3–4.7 weight percentage copper, and 0.8 weight percentage maximum iron. Accordingly, 0.85 pounds of a first alloy with the composition aluminum, 12.7 weight percentage silicon, and 0.024 weight percentage strontium are melted in a ceramic crucible and held at 583±5° C. Similarly, 0.15 pounds of a second alloy with the composition aluminum and 33 weight percentage copper are melted in a ceramic crucible and held at 551±5° C. The two alloys are mixed and the resultant alloy is immediately cast in a preheated metal mold. The chemistry of the resultant solidified alloy was measured using spark emission spectroscopy and the microstructure of polished metallographic samples taken from the solidified alloy was examined using optical and scanning electron microscopy. These characteristics of the resultant alloy are compared to the corresponding characteristics of standard 4145 aluminum alloy.

The measured chemistry of the alloy produced according to the present invention as described in this example is as follows: aluminum, 10.4 weight percentage silicon, 4.7 weight percentage copper, 0.1 weight percentage iron, and approximately 0.02 weight percentage strontium.

Figure 2A:
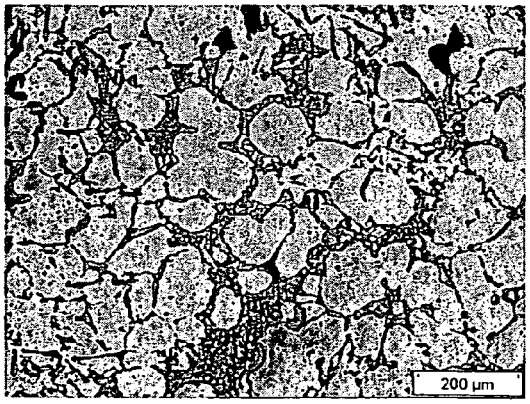
FIGS. 2A and 2B illustrate the microstructure of standard alloy 4145 produced (a) via a method of the present invention, and (b) via conventional permanent mold casting technology, respectively.
Figure 2B:
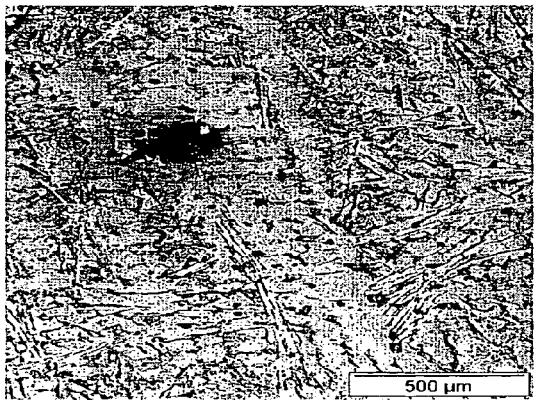

FIG. 2A shows the microstructure of the alloy produced according to the current invention as described in this example, and FIG. 2B shows the microstructure of standard 4145 wrought alloy. The morphology of the grains in the alloy produced according to the current invention as described in this example is predominantly spherical and there are very few, if any, dendrites in the microstructure. The interdendritic liquid in the alloy produced according to the invention as described in this example is more dispersed in the microstructure and envelopes the spherical grains. This microstructure, compared to that of standard 4145 wrought alloy, is predominantly globular and substantially free of dendrites, has much less tendency for hot tearing, and is more amenable to producing sound castings.

EXAMPLE 3

A method of the present invention is used to produce a cast component with the composition of standard 5056 alloy; namely, aluminum, 4.5–5.6 weight percentage magnesium and 0.05–0.2 weight percentage manganese. Accordingly, 0.14 pounds of a first alloy with the composition aluminum and 35 weight percentage magnesium are melted in a ceramic crucible and held at 455±5° C. Similarly, 0.86 pounds of commercially pure aluminum are melted in a ceramic crucible and held at 665±5° C. The two alloys are mixed and the resultant alloy is immediately cast in a preheated metal mold. The chemistry of the resultant solidified alloy was measured using spark emission spectroscopy and the microstructure of polished metallographic samples taken from the solidified alloy was examined using optical and scanning electron microscopy. These characteristics of the resultant alloy are compared to the corresponding characteristics of standard 5056 aluminum alloy.

The measured chemistry of the alloy produced according to the present invention as described in this example is as follows: aluminum, 5.0 weight percentage magnesium, 0.15 weight percentage manganese.

Figure 3A:
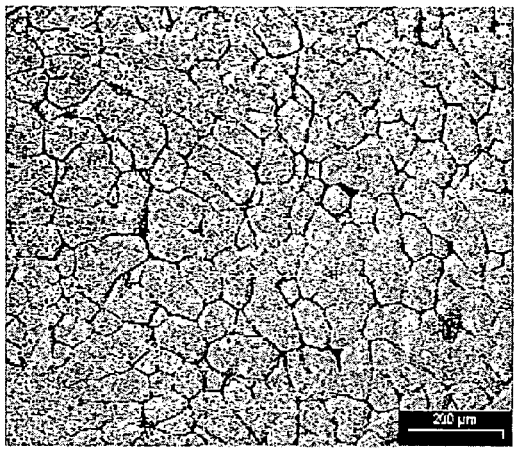
FIGS. 3A and 3B illustrate the microstructure of standard alloy 5056 produced (a) via a method of the present invention, and (b) via conventional permanent mold casting technology, respectively.
Figure 3B:
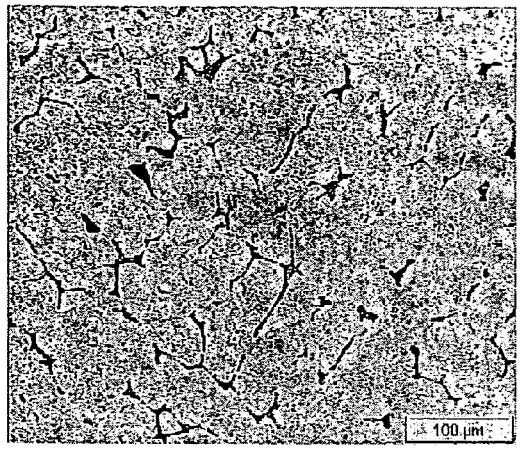

FIG. 3A shows the microstructure of the alloy produced according to the current invention as described in this example, and FIG. 3B shows the microstructure of standard 5056 wrought alloy. The morphology of the grains in the alloy produced according to the invention as described in this example is predominantly spherical and there are very few, if any, dendrites in the microstructure. The interdendritic liquid in the alloy produced according to the invention as described in this example is more dispersed in the microstructure and envelopes the spherical grains. This microstructure, compared to that of standard 5056 wrought alloy, is predominantly globular and substantially free of dendrites, has much less tendency for hot tearing, and is more amenable to producing sound castings.

EXAMPLE 4

Another method of the present invention is used to produce a cast component with the composition of standard 7050 alloy; namely, aluminum, 2.0–2.6 weight percentage copper, 1.9–2.6 weight percentage magnesium, and 5.7–6.7 weight percentage zinc. Accordingly, 0.11 pounds of a first alloy with the composition aluminum and 22 weight percentage copper are melted in a ceramic crucible and held at 600±5° C. Similarly, 0.89 pounds of a second alloy with the composition aluminum, 2.65 weight percentage magnesium, and 7.0 weight percentage zinc are melted in a ceramic crucible and held at 640±5° C. The two alloys are mixed and the resultant alloy is immediately cast in a preheated metal mold. The chemistry of the resultant solidified alloy was measured using spark emission spectroscopy and the microstructure of polished metallographic samples taken from the solidified alloy was examined using optical and scanning electron microscopy. These characteristics of the resultant alloy are compared to the corresponding characteristics of standard 7050 aluminum alloy.

The measured chemistry of the alloy produced according to the present invention as described in this example is as follows: aluminum, 2.5 weight percentage copper, 2.2 weight percentage magnesium, and 6.7 weight percentage zinc.

Figure 4A:
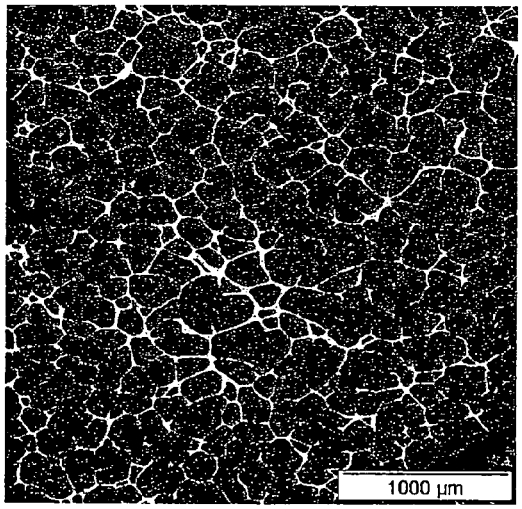
FIGS. 4A and 4B illustrate the microstructure of standard alloy 7050 produced (a) via a method of the present invention, and (b) via conventional permanent mold casting technology, respectively.
Figure 4B:
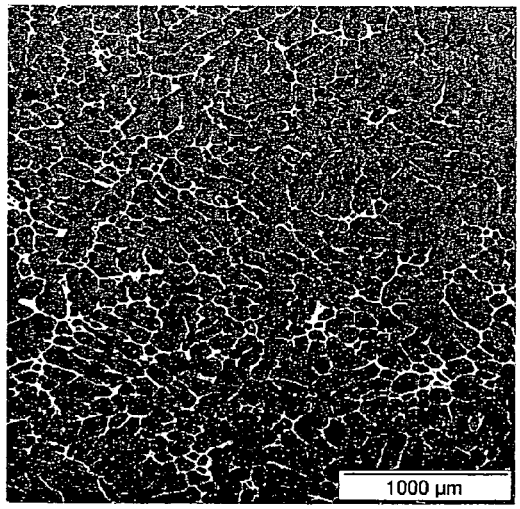

FIG. 4A shows the microstructure of the alloy produced according to the current invention as described in this example, and FIG. 4B shows the microstructure of standard 7050 wrought alloy. The morphology of the grains in the alloy produced according to the invention as described in this example is predominantly spherical and there are very few, if any, dendrites in the microstructure. The interdendritic liquid in the alloy produced according to the current invention as described in this example is more dispersed in the microstructure and envelopes the spherical grains. This microstructure, compared to that of standard 7050 wrought alloy, is predominantly globular and substantially free of dendrites, has much less tendency for hot tearing, and is more amenable to producing sound castings.

EXAMPLE 5

A method of the present invention is used to produce a cast component with a composition of standard 319 aluminum alloy; namely, aluminum, 5.5–6.5 weight percentage silicon, and 3–4 weight percentage copper. Accordingly, 346 grams of a first alloy with essentially the composition of standard A356 aluminum alloy are melted in a ceramic crucible and held at 621±5° C. Similarly, 50 grams of a second alloy with the composition aluminum and 33 weight percentage copper are melted in a ceramic crucible and held at 551±5° C. The two alloys are mixed and the resultant alloy is immediately cast in a preheated metal mold. The chemistry of the resultant solidified alloy was measured using spark emission spectroscopy and the microstructure of polished metallographic samples taken from the solidified alloy was examined using optical and scanning electron microscopy. These characteristics of the resultant alloy are compared to the corresponding characteristics of standard 319 aluminum alloy.

The measured chemistry of the alloy produced according to the present invention as described in this example is as follows: aluminum, 5.8 weight percentage silicon, and 3.6 weight percentage copper.

Figure 5:
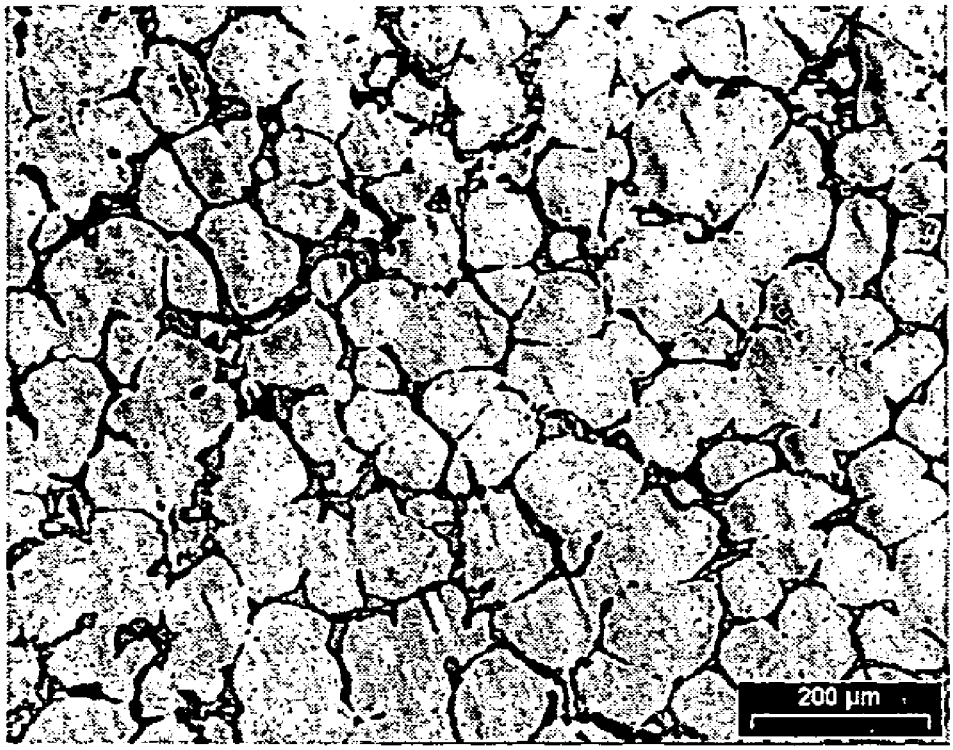
FIG. 5 illustrates the microstructure of standard alloy 319 produced via a method of the present invention.
Figure 6A:
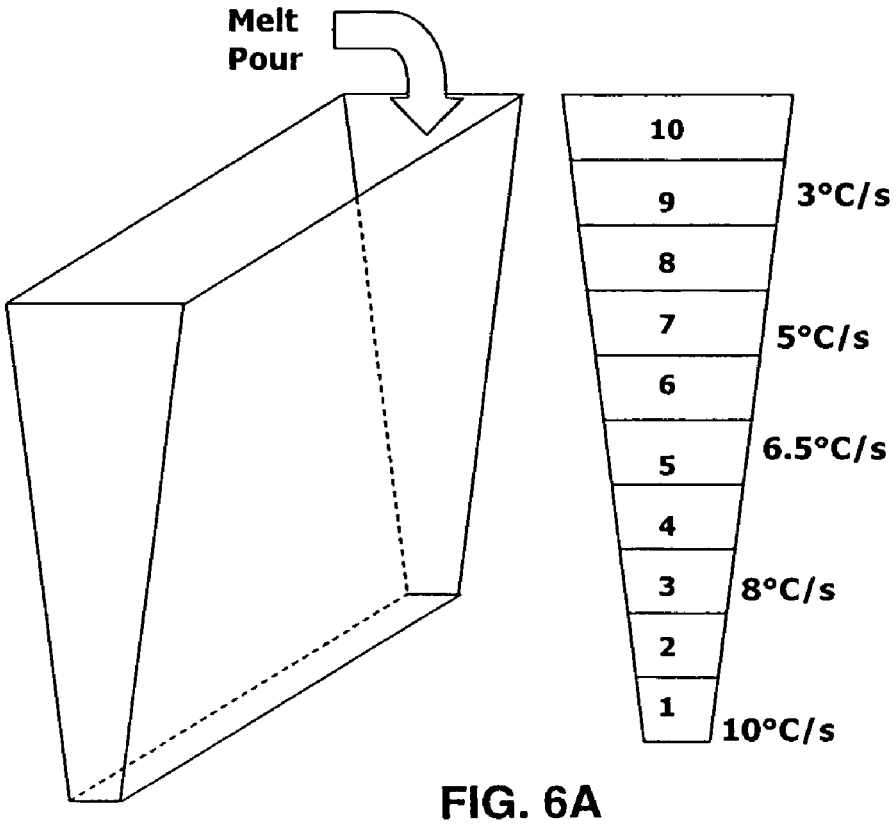
FIGS. 6A–6D illustrate (a) pipe formation in 2014 alloy castings poured in a wedge mold, (b) 2014 alloy cast using a method of the present invention, (c) 2014 alloy melted and cast with 5° C. super heat, and (d) 2014 alloy melted and cast with 50° C. super heat, respectively.
Figures 6B, 6C, 6D:
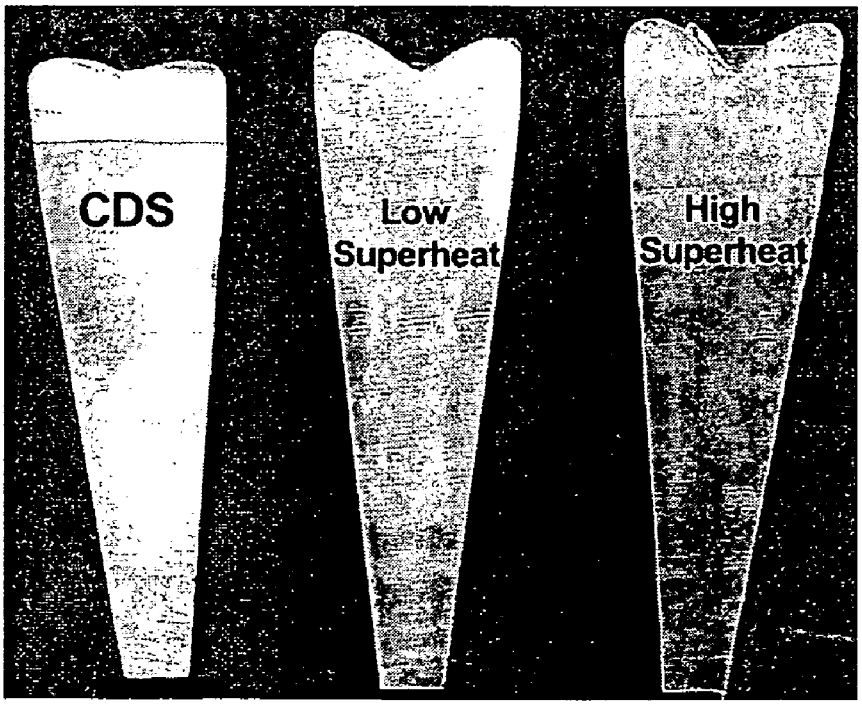

FIG. 5 shows the microstructure of the alloy produced according to the current invention as described in this example. The morphology of the grains in the alloy produced according to the invention as described in this example is predominantly spherical and there are very few, if any, dendrites in the microstructure. The interdendritic liquid in the alloy produced according to the current invention as described in this example is more dispersed in the microstructure and envelopes the spherical grains. This microstructure, compared to that of standard 319 alloy, is predominantly globular and substantially free of dendrites, has much less tendency for hot tearing, and is more amenable to producing sound castings.

EXAMPLE 6

About 0.86 pounds of commercially pure aluminum is melted in a ceramic crucible and held at 665±5° C. Similarly, 0.14 pounds of a second alloy with the composition aluminum+33 weight percentage copper is melted in a second ceramic crucible and held at 551±5° C. The two alloys are mixed and the resultant alloy is immediately cast in a preheated wedge shaped metal mold. In addition, and for the purpose of comparison, an alloy with similar chemistry is melted at 750±5° C. and cast using the traditional casting method into the same wedge shaped mold. For the traditional casting method, two different pouring temperatures were used, namely 700±5° C. and 663±5° C. FIGS. 6A–6D show cross sections of the castings produced and illustrates the extent of piping in, the casting produced using the method of the present invention, the casting produced using a typical traditional method and pouring the alloy at 663±5° C., and the casting produced using a traditional method and pouring the alloy at 700±5° C., respectively. The methods of this invention lead to less shrinkage of the cast component as indicated by less piping at the top surface than the traditional casting method, which implies a comparatively lower tendency towards hot tearing when the method of this invention is used.

EXAMPLE 7

Figures 7A, 7B, 7C:
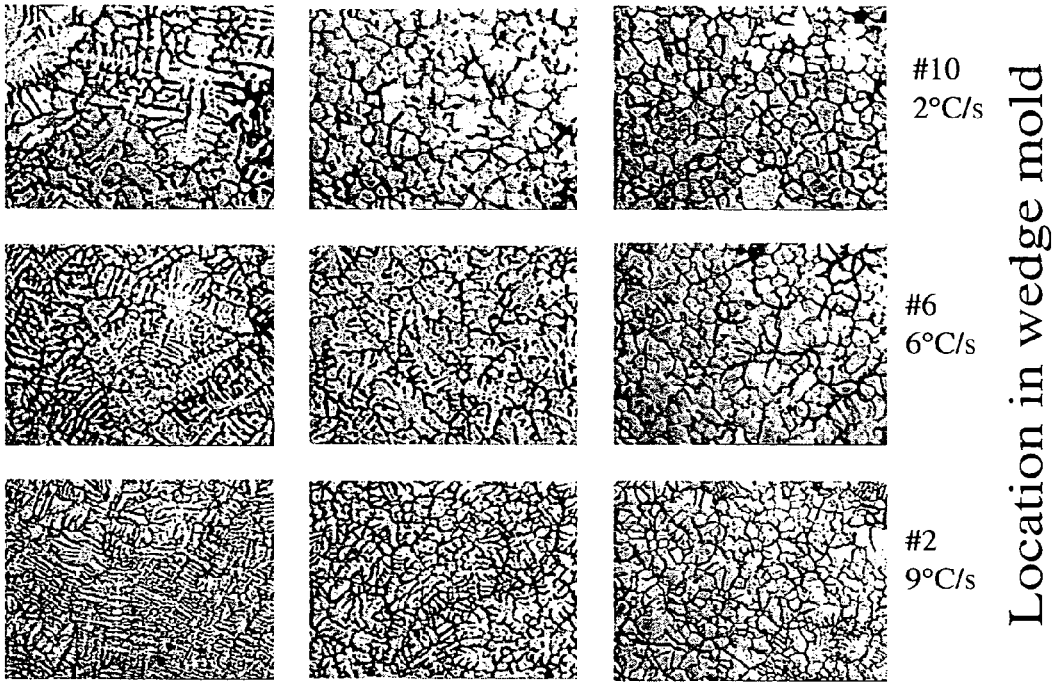
FIGS. 7A–7C illustrate as-cast microstructures of 2014 alloy samples at various locations in a wedge shaped casting, also shown are the section location numbers and the corresponding solidification rates as illustrated in FIG. 6A from where the respective microstructures were sectioned, (a) conventional casting with a 50° C. superheat, (b) conventional casting with a 5° C. superheat, and (c) casting via a method of the present invention, respectively.

About 0.86 pounds of commercially pure aluminum is melted in a ceramic crucible and held at 665±5° C. Similarly, 0.14 pounds of a second alloy with the composition aluminum+33 weight percentage copper is melted in a second ceramic crucible and held at 551±5° C. The two alloys are mixed and the resultant alloy is immediately cast in a preheated wedge shaped metal mold. The wedge shape of the mold insures a varying cooling rate along the depth of the mold so that the top slice of the casting, which is broad, cools slower than the bottom slice, which is comparatively narrow. In addition, and for the purpose of comparison, an alloy with similar chemistry is melted at 750±5° C. and cast using the traditional casting method into the same wedge shaped mold. For the traditional casting method, two different pouring temperatures were used, namely 700±5° C. and 663±5° C. FIGS. 7A–7C show representative microstructures of solidified samples taken at various depths in the wedge mold. The predominantly globular microstructure and the lack of dendrites in the casting produced using the method of the present invention at all cooling rates is to be noted.

EXAMPLE 8

A method of the present invention is used to produce an automotive cast component, namely an automatic breaking system (ABS) housing, with the composition of standard 2014 alloy; namely, aluminum, 3.9–5.0 weight percentage copper, 0.2–0.8 weight percentage magnesium, and 0.4–1.2 weight percentage manganese. Accordingly, 500 pounds of commercially pure aluminum is melted in a ceramic crucible and held at 668±5° C. (precursor liquid alloy #1). Similarly, 225 pounds of a second alloy with the composition aluminum+33 weight percentage copper is melted in a second ceramic crucible and held at 600±5° C. (precursor liquid alloy #2). For each casting, 0.75 of precursor liquid alloy #2 is ladled into the pouring cup of a permanent mold and its temperature is continuously monitored. When the temperature reaches 550° C., precursor liquid alloy #1 is added until the cup was completely full. The total weight of the combined precursor alloys is 6 pounds. These portions of Al-33 weight percentage copper and commercial purity Al insure that the chemistry of the resultant alloy matches that of 2014 alloy. Immediately after adding precursor liquid alloy #1, the mold, which has two cavities, is tilted to fill the cavities. A total of 10 castings (20 parts) were made using this procedure with no miss-runs. The resultant castings were sound and die penetrant tested and did not reveal any surface cracks or tears.

EXAMPLE 9

A method of the present invention is used to produce a plate-like cast component with the composition of standard 2014 alloy; namely, aluminum, 3.9–5.0 weight percentage copper, 0.2–0.8 weight percentage magnesium, and 0.4–1.2 weight percentage manganese. Accordingly, 1.4 pounds of a first alloy with the composition aluminum+33 weight percentage copper is melted in a ceramic crucible and held at 550±5° C. (precursor liquid alloy #1). Similarly, 8.6 pounds of a second alloy with the composition aluminum+1 weight percentage silicon+1 weight percentage manganese+0.65 weight percentage magnesium was melted in a second ceramic crucible and held at 660±5° C. (precursor liquid alloy #2). Precursor liquid alloy #2 was added to precursor alloy #1 and the resultant alloy was immediately poured into the pouring cup of a resin bonded sand mold. These portions of precursor liquid alloy #1 and precursor liquid alloy #2 insure that the chemistry of the resultant alloy matches that of 2014 alloy. Several castings were made using this procedure with no miss-runs. The resultant castings were sound and die penetrant tests did not reveal any surface cracks or tears.

The embodiments of the present invention contemplate the inclusion of particular additional alloying ingredients in order to obtain certain desired results. For example, one may include small but effective amounts of the elements of silicon, nickel, antimony or lead to improve mechanical properties, corrosion resistance, stress corrosion resistance, processing characteristics, machinability and other such properties.

In all instances where percentages are given herein, the percentages comprise percent by weight. The alloy of the present invention may be cast in any convenient manner.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more or fewer elements may be used in the block diagrams.

The claims should not be read as limited to the described order or elements unless stated to that effect. Therefore, all embodiments that come within the scope and spirit of the following claims and equivalents thereto are claimed as the invention.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more or fewer elements may be used in the diagrams. While various elements of the preferred embodiments have been described as being implemented in software, other embodiments in hardware of firmware implementations may alternatively be used, and vice-versa.

Other aspects, modifications, and embodiments are within the scope of the following claims.

What is claimed is:

1. A method for casting alloys, comprising:

heating a first aluminum-based alloy to form a first liquid alloy of a first composition ($C_1$) at a first temperature ($T_1$);

heating a second alloy to form a second liquid alloy of a second composition ($C_2$) at a second temperature ($T_2$) such that ($T_1$) is great than ($T_2$), and wherein the first composition ($C_1$) has a lesser weight percent of total alloying elements as compared to the second composition ($C_2$);

combining the first liquid alloy and second liquid alloy to form a supercooled resultant alloy; and casting supercooled the resultant alloy to produce a solid alloy with at least one of a predominantly globular, cellular, and rosette like microstructure that is substantially free of dendrites.

2. The method of claim 1, wherein the first alloy has a component comprising at least one of copper, zinc, and magnesium, and silicon.

3. The method of claim 1, wherein the second alloy has a component comprising at least one of copper, zinc, and magnesium, and silicon.

4. The method of claim 1, wherein the first aluminum-based alloy is commercially pure aluminum and the second alloy comprises copper in the range from about 3% to about 33%.

5. The method of claim 4, further comprising heating said first aluminum-based alloy and second alloy to a temperature in the range of 0° C. to 30° C. above their respective liquidus temperatures.

6. The method of claim 1, further comprising adjusting the weight percentage of the first aluminum-based alloy and the second alloy in order to provide a pre-determined composition.

7. The method of claim 1, wherein the resultant solid alloy comprises copper as the major alloying element with or without any combination of actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

8. The method of claim 1, wherein the resultant solid alloy comprises magnesium as the major alloying element with or without any combination of actinium, antimony, barium, beryllium, bismuth, boron, bromine, cadmium, calcium, cerium, cesium, chromium, cobalt, erbium, gallium, germanium, gold, hafhium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

9. The method of claim 1, wherein the resultant solid alloy comprises silicon as the major alloying element with or without any combination of actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

10. The method of claim 1,wherein the resultant solid alloy comprises zinc as the major alloying element with or without any combination of actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

11. The method of claim 1, wherein the resultant solid alloy comprises a combination of copper and magnesium as the major alloying elements with or without any combination of actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

12. The method of claim 1, wherein the resultant solid alloy comprises a combination of copper, magnesium, and silicon as the major alloying elements with or without any combination of actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

13. The method of claim 1, wherein the resultant solid alloy comprises a combination of copper, magnesium, silicon, and zinc as the major alloying elements with or without any combination of actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

14. The method of claim 1, wherein the resultant solid alloy comprises copper as the major alloying element with or without any combination of actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

15. The method of claim 1, wherein the resultant solid alloy comprises magnesium as the major alloying element with or without any combination of actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

16. The method of claim 1, wherein the resultant solid alloy comprises silicon as the major alloying element with or without any combination of actinium, antimony, barium, beryllium, bismuth, boron, bromine, cadmium, calcium, cenum, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

17. The method of claim 1, wherein the resultant solid alloy comprises zinc as the major alloying element with or without any combination of actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

18. The method of claim 1, wherein the resultant solid alloy comprises a combination of copper and magnesium as the major alloying elements with or without any combination of actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

19. The method of claim 1, wherein the resultant solid alloy comprises a combination of copper, magnesium, and silicon as the major alloying elements with or without any combination of actinium, antimony, barium, beryllium, bismuth, boron, bromine, cadmium, calcium, cerium, cesium, chromium, cobalt, erbium, gallium, germanium, gold, hafnium, iron, lanthanum, lead, lithium, manganese, molybdenum, neodymium, nickel, niobium, phosphorus, platinum, potassium, scandium, selenium, silver, sodium, strontium, sulfur, tin, titanium, vanadium, ytterbium, yttrium, zinc, zirconium, and/or rare earth elements in lesser quantities.

* * * * *